United States Patent [19]

Miele

[11] 4,215,435

[45] Aug. 5, 1980

[54] CONVERTIBLE TROUSERS

[76] Inventor: Joseph Miele, 204 Port Royal Dr., H.C.B., Toms River, N.J. 08753

[21] Appl. No.: 912,754

[22] Filed: Jun. 5, 1978

Related U.S. Application Data

[63] Continuation of Ser. No. 763,414, Jan. 28, 1977, abandoned.

[51] Int. Cl.[2] ..... A41D 1/06

[52] U.S. Cl. ..... 2/227; 2/269

[58] Field of Search ..... 2/227, 228, 240, 269, 2/80, 74

[56] References Cited

U.S. PATENT DOCUMENTS

| | | | |
|---|---|---|---|
| 2,440,752 | 5/1948 | Mathews | 2/80 X |
| 3,266,057 | 8/1966 | Phelps | 2/227 |

FOREIGN PATENT DOCUMENTS

| | | | |
|---|---|---|---|
| 1563149 | 3/1969 | France | 2/74 |
| 458253 | 8/1968 | Switzerland | 2/227 |

*Primary Examiner*—H. Hampton Hunter

*Attorney, Agent, or Firm*—Robert D. Farkas

[57] ABSTRACT

Convertible trousers including a body portion configured to be placed on the lower half of a human torso in a conventional manner, a pair of leg portions for accommodating therein a pair of human legs, the leg portions each comprising a plurality of flexible interchangeable tubular elements, and means for selectively removeably securing the flexible interchangeable tubular elements coextensively together. The tubular elements may be joined to the body portion in various configurations to produce a garment of a variable length which may be altered to present several different visual appearances.

6 Claims, 4 Drawing Figures

CONVERTIBLE TROUSERS

This application is a Continuation of prior U.S. application Ser. No. 763,414 filed on Jan. 28, 1977 and now abandoned.

BACKGROUND OF THE INVENTION

1. Field of the Invention

The present invention relates to trousers, and more particularly, to trousers which are variable in length and which may be altered to present several interchangeable distinctive visual appearances.

2. Description of the Prior Art

Increasing costs in wearing apparel has led to a trend of coordinated wardrobes where a single garment may be used as a portion of several different outfits. Frequently, a single outfit may be varied by the inclusion of a pair of trousers, shorts, or a pair of slacks of intermediate length. Presently known garments which have been proposed in more than one of these capacities have proven to be bulky, unattractive, and of limited flexibility.

Typical of convertible trousers presently known are the pantaloons disclosed in U.S. Pat. No. 269,479 issued to J. T. Stretch et al on Dec. 19, 1882. Disclosed therein is a pantaloon in which the legs thereof from the knee down are detachably connected to the legs above the knees. Resultantly, the pantaloons may be changed from long pants to knee britches or the reverse by the fastening or unfastening of the detachable leg portions.

The present invention overcomes the shortcomings of the prior art and furthers the state of the art by providing a convertible trouser which may be varied in length and visual appearance to suit the taste of the user.

SUMMARY OF THE INVENTION

Therefore, a primary object of the present invention is to provide a convertible trouser which may be adjusted to provide various leg lengths.

A further object is to provide convertible trousers which may be modified to present various visual appearances by limitless combinations of colors and patterns.

A still further object of the present invention is to provide convertible trousers wherein the leg portions thereof may be easily and quickly removed and joined as desired.

Another object is to provide convertible trousers which may be modified from flare legs to straight legs.

Still another object is to provide convertible trousers which are simple in design, inexpensive to manufacture, and durable.

These objects, as well as further objects and advantages, of the present invention will become readily apparent after reading the description of a non-limiting illustrative embodiment and the accompanying drawing.

Convertible trousers according to the principles of the present invention include a body portion configured to accommodate therein the lower half of a human torso, the body portion providing a pair of apertures to accommodate a pair of human legs disposed therethrough, a pair of leg portions for accommodating therein the pair of human legs, the leg portions each comprising a plurality of flexible interchangeable tubular elements each having an uppermost edge and a lowermost edge, and means for selectively removeably securing each of the uppermost edges to a lowermost edge of one of the tubular elements, each of the tubular elements being removeably securable to at least another one of the tubular elements, at least one of the plurality of tubular elements being affixable to the body portion adjacent the apertures located therein, several of the tubular elements being distinctive in visual appearance.

BRIEF DESCRIPTION OF THE DRAWINGS

In order that the present invention may be more fully understood it will now be described, by way of example, with reference to the accompanying drawings in which.

DESCRIPTION OF THE PREFERRED EMBODIMENT

Figure 1:
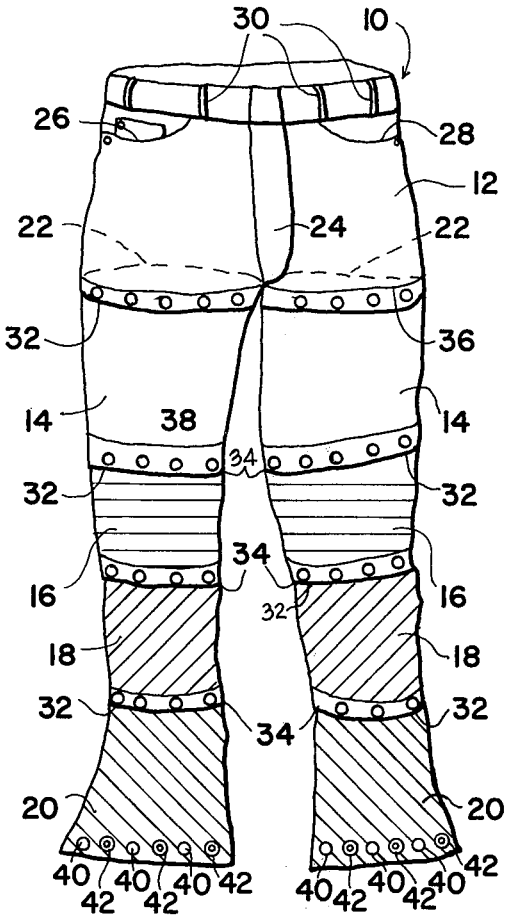
FIG. 1 is a pictorial representation of the preferred embodiment of the present invention assembled as a full length trouser.

Referring now to the figures, and more particularly to FIG. 1, there is illustrated therein a pair of convertible trousers 10. The convertible trousers 10 include a body portion 12 and a plurality of flexible interchangeable tubular elements 14, 16, 18, and 20. The body portion 12 is configured in a conventional manner to accommodate therein the lower half of a human torso. A pair of apertures 22 dimensioned to accommodate a pair of human legs therethrough are located in the body portion 12. The body portion 12 is preferably provided with a zipper closure 24, a pair of pockets 26 and 28, and a plurality of belt loops 30. The flexible interchangeable tubular elements 14, 16, 18, and 20 each provide an uppermost edge 32 and a lowermost edge 34. The uppermost edge 32 of the flexible interchangeable tubular element 14 is fixedly removeably secured to the lowermost edge 36 of the body portion 12 adjacent the apertures 22 located therein. The uppermost edge 32 of the tubular element 16 is removeably secured to the lowermost edge 34 of the tubular element 14, the uppermost edge 32 of the tubular element 18 is removeably secured to the lowermost edge 34 of the tubular element 16, and the uppermost edge 32 of the tubular element 20 is removeably secured to the lowermost edge 34 of the tubular element 18. The body portion 12 and the flexible interchangeable tubular elements 14, 16, 18, and 20 are removeably secured together by a plurality of snap sets 38 each having a male snap 40 and a female snap 42. the female snaps 42 are fixedly secured adjacent the lower edge 36 of the body portion 12, and to the lowermost edges 34 of the flexible interchangeable tubular elements 14, 16, 18, and 20. The female snaps 42 are fixedly secured to the uppermost edges 32 of the flexible interchangeable tubular elements 14, 16, 18, and 20. Each of the flexible interchangeable tubular elements 14, 16, 18, and 20 are provided with distinctive designs and may vary in coloration and type of material. The flexible interchangeable tubular elements may be interchanged or deleted to provide garments of different lengths which have various visual appearances. The interchangeable tubular element 20 may be provided with both male and female snaps 40 and 42 adjacent the lowermost edge 34 thereof, as shown. As shown, both tubular elements 20, are shown having the lowermost edge provided with snap elements 40, being the the male variety, and female snap elements 42, disposed adjacent the lowermost edges thereof. When it is desired to install tubular element 20, or any other similarly equipped tubular element, in upside-down fashion, such that the lowermost edge, as shown, is supported in an uppermost position, the female snaps 42, secured to the lowermost edge of tubular element 20, are adapted to engage nothing, whilst the male snaps 40, engage the female snaps 42, already located at the bottom edge of tubular element 18. In this fashion, any tubular element may be installed in the position shown, or in an inverted position, as desired, thereby permitting the design of such tubular element to be inverted creating a pleasing effect thereby, or, if desired, permitting a flared type tubular element to be inverted, so as to provide for a "baggy knee" effect, if desired, from a flared type tubular element. The combinations of locations, placement of pocket elements, not shown, the ability to rotate as well as invert, provides an unlimited number of combinations and variations in placement, location, and direction of each tubular element, relative to another. Resultantly, the flexible interchangeable tubular element 20 may be reversed to alter the garment from a flare leg to a straight leg.

Figure 2:
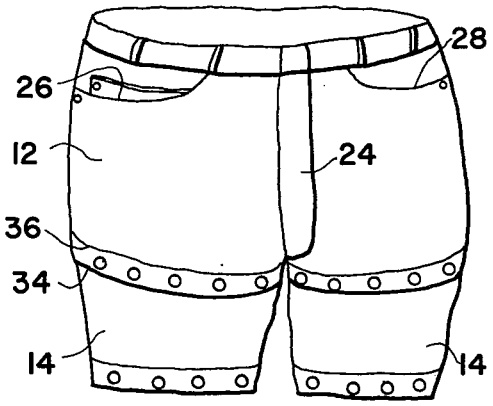
FIG. 2 is a pictorial representation of the preferred embodiment of the present invention assembled as walking shorts.

FIG. 2 illustrates the body portion 12 with the flexible interchangeable tubular element 14 removeably secured thereto. This arrangement provides a "shorts" type garment. The interchangeable tubular elements 14 may be constructed of a material similar to that fabricating the body portion 12 or the tubular elements 14 may be constructed of a different material having a different design or color.

Figure 3:
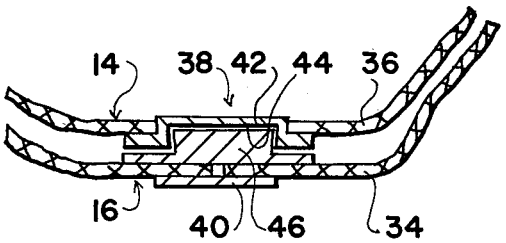
FIG. 3 illustrates the manner in which the flexible interchangeable tubular elements of the present invention are assembled.

FIG. 3 illustrates the manner in which the flexible interchangeable tubular elements 14, 16, 18, and 20 are fastened together by the snap sets 38. The snap set 38 is shown fastening a portion of the tubular element 14 to a portion of the tubular element 16. The male snap 40 is fixedly secured to the portion of the tubular element 16 and the female snap 42 is fixedly secured to the portion of the tubular element 14. The female snap 42 provides an open ended chamber 44. The open ended chamber 44 is dimensioned to capture and frictionally removeably retain therein an extensive portion 46 provided by the male snap 40.

Figure 4:
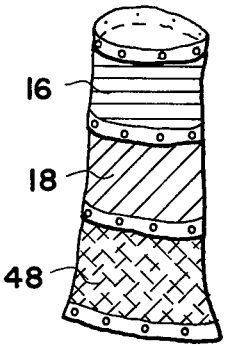
FIG. 4 is a pictorial representation of a plurality of flexible interchangeable tubular elements joined together.

FIG. 4 illustrates the flexible interchangeable tubular elements 16 and 18 having a tubular element 48 secured thereto. The tubular element 48 modifies the garment illustrated in FIG. 1 from a flare leg to a straight leg. The flexible interchangeable tubular elements 16, 18, and 48 are joined together by a plurality of snap sets 38 as illustrated in FIG. 3. The male snaps 40 are preferably secured to the inner surface of the tubular elements and the female snaps 42 are preferably secured to the outer surface of the tubular elements as illustrated in FIG. 3. The flexible interchangeable tubular elements 14, 16, 18, 20, and 48 may be interchanged to provide garments of various lengths and having different visual appearances.

A primary advantage of the present invention is to provide a convertible trouser which may be adjusted to provide various leg lengths.

A further advantage is to provide convertible trousers which may be modified to present various visual appearances by limitless combinations of colors and patterns.

A still further advantage of the present invention is to provide convertible leg trousers wherein the leg portions thereof may be easily and quickly removed and joined as desired.

Another advantage is to provide convertible trousers which may be modified from flare legs to straight legs.

Still another advantage is to provide convertible trousers which are simple in design, inexpensive to manufacture, and durable.

It will be understood that various changes in the details, materials, arrangements of parts and operation conditions which have been herein described and illustrated in order to explain the nature of the invention may be made by those skilled in the art within the principles and scope of the invention.

Having thus set forth the nature of the invention, what is claimed is:

1. Convertible trousers comprising a body portion configured to accommodate therein the lower half of a human torso, said body portion providing a pair of apertures to accommodate a pair of human legs disposed therethrough, a pair of leg portions for accommodating therein said pair of human legs, said leg portions each comprising a plurality of flexible interchangeable tubular elements each having an uppermost edge and a lowermost edge, and means for selectively removably securing each of said uppermost edges to a lowermost edge of one of said tubular elements including a plurality of male snaps and a plurality of cooperating female snaps, said plurality of male snaps being fixedly secured adjacent to the lowermost edges of each of said plurality of tubular elements and to said body portion adjacent said apertures thereof, said plurality of female snaps being fixedly secured adjacent to the uppermost edges of each of said plurality of tubular elements, said plurality of male snaps and said plurality of female snaps being disposed in uniform spaced apart relationship and being disposed removably engaged to one another, a portion of each of said plurality of male snaps being located on an exterior surface of said tubular elements, whereby said portion of said each of said plurality of male snaps is visually accessible when the remaining portion of said each of said plurality of male snaps are engaged to adjacent female snaps of said plurality of female snaps, each of said tubular elements being removeably securable to at least another one of said tubular elements, at least one of said plurality of tubular elements being affixable to said body portion adjacent said apertures located therein, several of said tubular elements being distinctive in visual appearance, one of said each of said tubular elements having another plurality of female snaps secured adjacent the lowermost edge thereof, whereby said lowermost edge and said uppermost edge of said one of said each of said tubular elements may be selectively secured to said lowermost edge of said another one of said tubular elements.

2. Convertible trousers as claimed in claim 1, wherein said male snaps are secured to the innermost surfaces of said tubular elements and said female snaps are secured to the outermost surfaces thereof.

3. The convertible trousers as claimed in claim 1 wherein any of said plurality of tubular elements has said uppermost edge thereof equal in size to said lowermost edge thereof.

4. The convertible trousers as claimed in claim 1 wherein any sub-plurality of said plurality of tubular elements is of different length from the length of the remainder of said plurality of tubular elements.

5. The convertible trousers as claimed in claim 1 wherein said means for selectively removeably attaching comprises an additional plurality of male snaps being fixedly secured adjacent said female snaps and an additional plurality of female snaps being fixedly secured adjacent said male snaps.

6. The convertible trousers as claimed in claim 5 wherein said additional plurality of male snaps are disposed in uniform spaced apart relationship and said additional plurality of female snaps are disposed in uniform spaced apart relationship.

* * * * *